US008263847B2

(12) United States Patent
Saravis

(10) Patent No.: US 8,263,847 B2
(45) Date of Patent: Sep. 11, 2012

(54) PORTABLE DRUM

(76) Inventor: Darren Saravis, Long Beach, CA (US)

( * ) Notice: Subject to any disclaimer, the term of this patent is extended or adjusted under 35 U.S.C. 154(b) by 0 days.

(21) Appl. No.: 12/843,638

(22) Filed: Jul. 26, 2010

(65) Prior Publication Data

US 2011/0017045 A1 Jan. 27, 2011

Related U.S. Application Data

(63) Continuation-in-part of application No. 12/742,204, filed as application No. PCT/US2008/070684 on Jul. 21, 2008.

(60) Provisional application No. 60/961,336, filed on Jul. 19, 2007.

(51) Int. Cl.
*G10D 13/02* (2006.01)

(52) U.S. Cl. ..... 84/411 R

(58) Field of Classification Search ..... 84/411 R, 84/421

See application file for complete search history.

(56) References Cited

U.S. PATENT DOCUMENTS 7,781,660 B2 * 8/2010 Paterson ..... 84/412

OTHER PUBLICATIONS

Guitar Center; Remo Modular Drum Kit; Item #446792; www.guitarcenter.com/Remo-Modular-Drum-Kit-446792-11274061.gc.

* cited by examiner

*Primary Examiner* — Kimberly Lockett
(74) *Attorney, Agent, or Firm* — The Eclipse Group LLP

(57) ABSTRACT

A portable drum that includes a drum head and a detachable drum shell, where the drum head may include an upper drum head and a detachable lower drum head and the drum shell may include one or more detachable sections. Once assembled, the upper drum head, the detachable lower drum head, and the sections of the drum shell may be held in place by a tensioning system that may include vertical straps and a waist belt strap. The portable drum may be disassembled and placed in a travel mode by nesting the sections of the drum shell in the lower drum head, and then placing the lower drum head into the upper drum head.

11 Claims, 16 Drawing Sheets

PORTABLE DRUM

CROSS REFERENCE TO RELATED APPLICATIONS

This application is a continuation-in-part of U.S. patent application Ser. No. 12/742,204, which was filed Oct. 13, 2010, as a US National Stage Application under 35 USC 371 from PCT/US08/70684, which was filed Jul. 21, 2008, which claims priority under 35 U.S.C. §119(e) to U.S. Provisional Patent Application Ser. No. 60/961,336, which was filed Jul. 19, 2007, entitled "Portable Drum," all of which applications are incorporated by reference into this application in their entireties.

BACKGROUND

1. Field of the Invention

This invention relates generally to musical instruments. In particular, the invention relates to a portable drum.

2. Description of the Related Art

In general, a drum is a musical instrument consisting of a frame or hollow vessel of wood, metal, or earthenware, called a shell, with a membrane of hide or plastic, called a head, stretched across one or both ends, and sounded by percussion; that is, by striking the instrument with the hands or with sticks. Drums come in a wide variety of shapes and sizes. For example, there is the African Djembe drum where the drum shell is carved from a single piece of wood and the drum head may be dried goat skin.

The quality of the sound of the drum is largely dependent on the shell design and the material used in its construction. The height of the drum shell is an important factor as its size defines the length of the sound waves it amplifies. For example, generally the height of the drum shell should be between 23 and 26 inches to accommodate the required bass sound.

Because of the size of the various drums, there is a need for a portable drum that may be transported from place to place more easily and efficiently as a single unit and that may then be set up and used while maintaining its original sound characteristics. Additionally, there is therefore a need for this portable drum to include a tensioning system that connects the various parts of the portable drum and maintains the sound quality of the portable drum and also allows for its tuning as conditions warrant.

SUMMARY

A portable drum is described. The portable drum may include a drum head and a detachable drum shell, where the drum head may include an upper drum head and a detachable lower drum head and the drum shell may include one or more detachable sections. Once assembled, the upper drum head, the detachable lower drum head, and the sections of the drum shell may be held in place by a tensioning system that may include vertical straps and a waist belt strap. The portable drum may be disassembled and placed in a travel mode by nesting the sections of the drum shell in the lower drum head, and then placing the lower drum head into the upper drum head.

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE FIGURES

The components in the figures are not necessarily to scale, emphasis instead being placed upon illustrating the principles of the invention. In the figures, like reference numerals designate corresponding parts throughout the different views.

DETAILED DESCRIPTION

Figure 1:
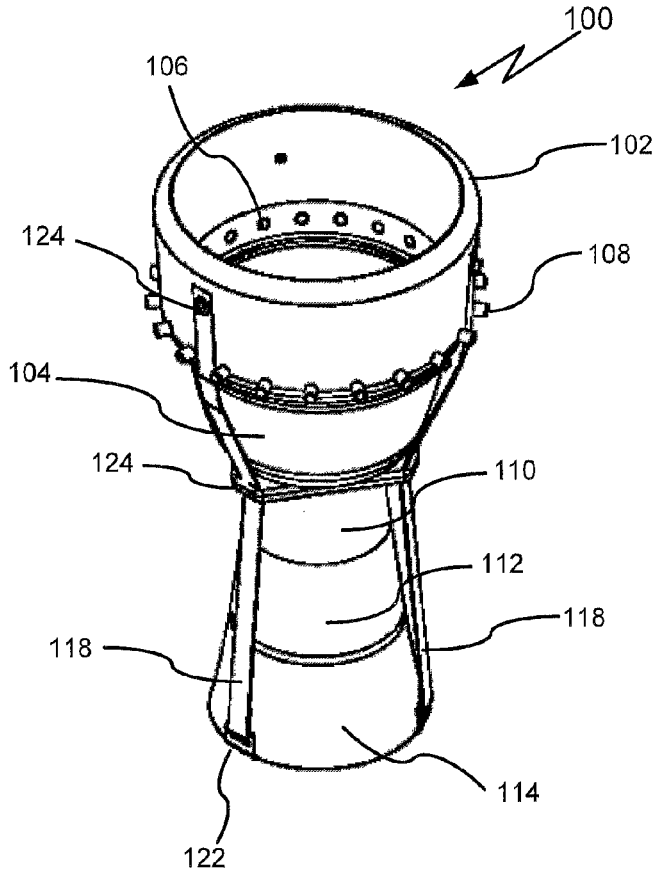
FIG. 1 shows a top front perspective view of one example of an implementation of a portable drum in an assembled state (or play mode).

In FIG. 1, a perspective top front-view of an example of an implementation of a portable drum in an assembled state (or play mode) is shown. In general, a drum may include a drum head and a drum shell. The portable drum 100 may include an upper drum head 102 and a lower drum head 104. The upper drum head 102 may include holes 106 placed equidistantly around the circumference of the upper drum head 102. Anchor pegs 108 are inserted into the holes 106 and utilized to secure ropes or lines that are connected to rings or other connectors on a membrane (not shown) that is stretched over the top of the upper drum head 102, thus creating the surface that is struck to produce the desired sound.

In FIG. 1, the drum shell includes a first section 110, a second section 112, and a third section 114, with the first section 110 resting on the second section 112, and the second section 112 resting on the third section 114. One of ordinary skill in the art will appreciate that in other embodiments the drum shell may comprise a single section, two sections, or three or more sections.

Once the upper drum head 102, the lower drum head 104, the first section 110, the second section 112, and the third section 114 are fitted together, these elements are secured in place by vertical straps 118. For example, the portable drum 100 of FIG. 1 utilizes three such vertical straps, of which only two are shown in FIG. 1. Each vertical strap 118 is connected to the upper drum head 102 by first attachment element 124 and to the third section 114 by second attachment element 122. In the example of an implementation shown in FIG. 1, second attachment element 122 is a clamp that fits into an indent made in the bottom rim of the third section 114. The use of such a clamp allows for easy disassembly of the portable drum when it is in play mode.

Portable drum 100 may also include means for adjusting and tightening the vertical straps 118, such as, for example, D-rings, flattened D-rings, and D-rings in combination with Velcro® fasteners. Velcro® fasteners may also be used to tie down any loose ends of the vertical straps 118.

Portable drum 100 may also include a waist belt strap 124, which is placed around the middle of the portable drum 100 and the vertical straps 118 and then tightened. This use of a waist belt strap 124 draws the vertical straps 118 inward to more closely follow the contour of the portable drum 100, as well as increasing the compression forces of the vertical straps 118 by altering the angle of the vertical straps 118 relative to the portable drum 100. The waist belt strap 124 may be any type of elastic or nylon cord or rope, such as a bungee cord.

Figure 2B:
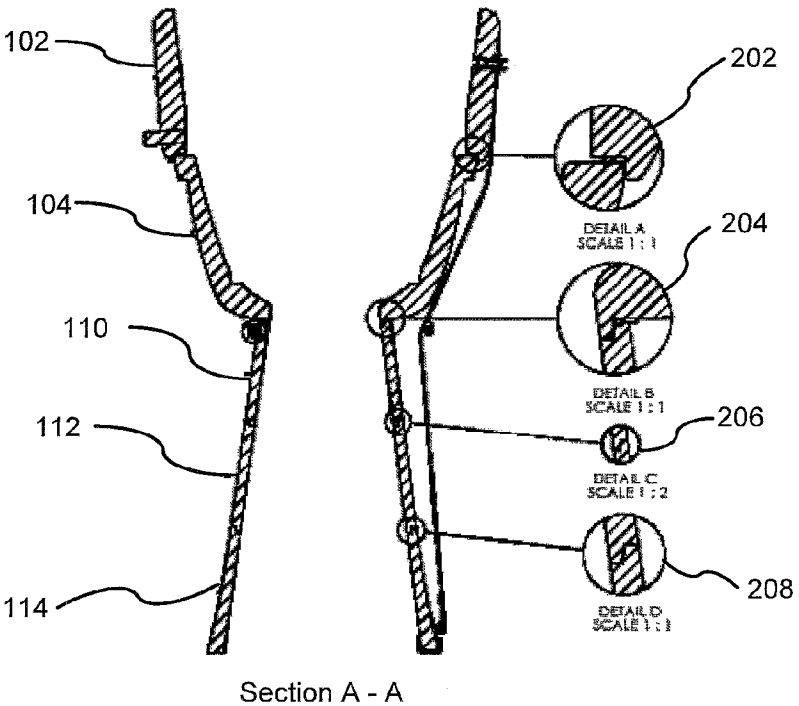
FIG. 2B shows a cross-sectional view of the portable drum of FIG. 1 taken along the line AA shown in FIG. 2A.
Figure 2A:
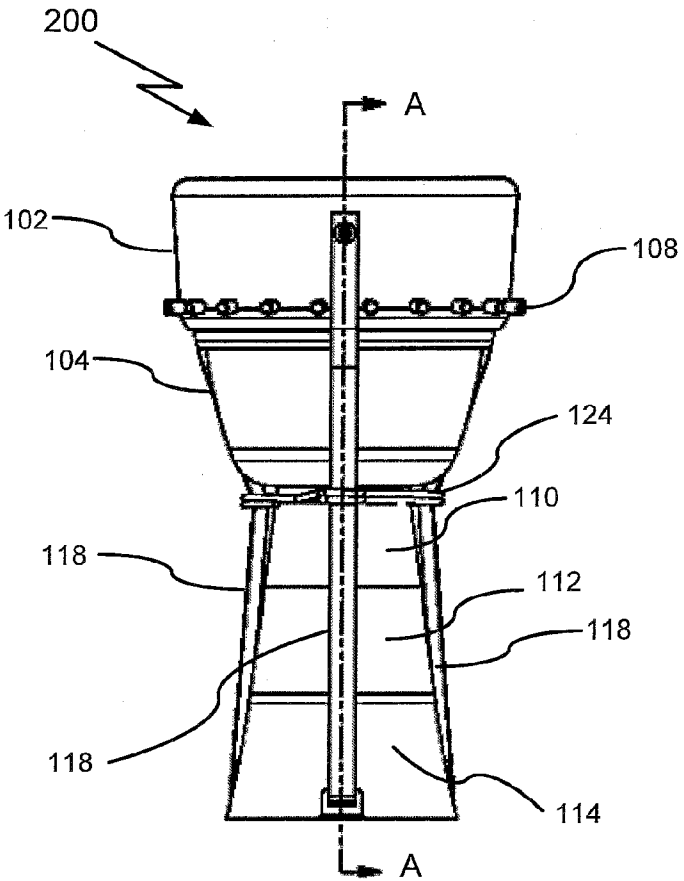
FIG. 2A shows a front view of the portable drum of FIG. 1.

FIG. 2A shows a front view of the portable drum of FIG. 1 in an upright position, as it would appear if placed firmly on an even surface in play mode. In this view, the three vertical straps 118 are visible, with each of the parts having the same reference numbers as FIG. 1.

FIG. 2B shows a cross-sectional view of the portable drum of FIG. 1 taken along the line AA shown in FIG. 2A, where the second section 112 of the drum shell rests on the third section 114 of the drum shell, the first section 110 of the drum shell rests on the second section 112, the lower drum head 104 rests on the first section 110, and the upper drum head 102 rests on the lower drum head 104 of the portable drum. FIGS. 202, 204, 206, and 208 show in greater detail an example of an implementation of a detachable interconnection between the upper drum head 102 and the lower drum head 104, the lower drum head 104 and the first section 110 of the drum shell, the first section 110 and the second section 112 of the drum shell, and the second section 112 and the third section 114 of the drum shell, respectively.

Figure 3:
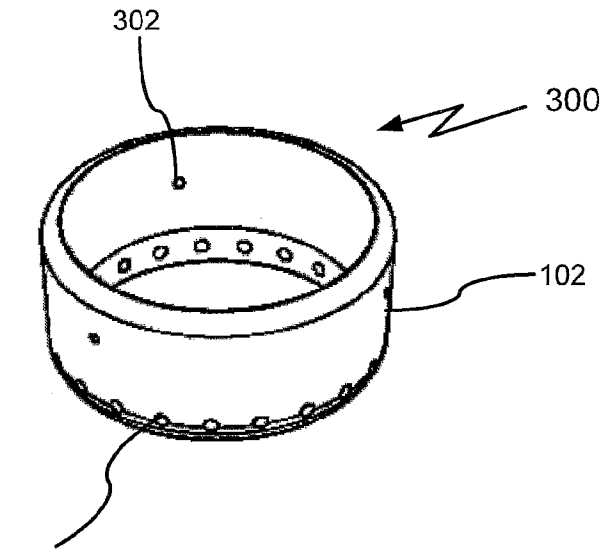
FIG. 3 shows a top perspective view of the upper drum head of the portable drum shown in FIG. 1.

In FIG. 3, a top perspective view of the upper drum head 102 of FIG. 1 is shown. The upper drum head 102 may have anchor holes 106 placed equidistantly around the circumference of the upper drum head 102, which are utilized to hold anchor pegs (not shown) that secure ropes or lines that are connected to rings or other connectors on a membrane (not shown) that is stretched over the top of the upper drum head 102. Bolts or other mechanical fasteners may be inserted into holes 302, three in number, to attach the first attachment elements 124, FIG. 1, to the upper drum head 102, where the first attachment elements 124 are utilized to anchor the vertical straps 118, FIG. 1, to the portable drum 100.

Figure 4B:
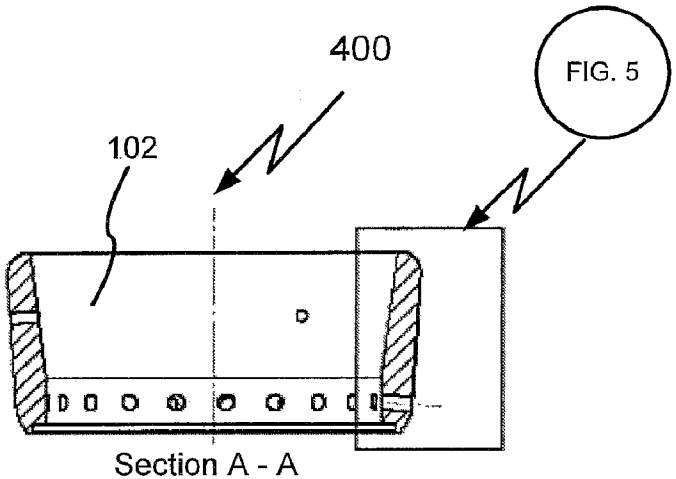
FIG. 4B shows a cross-sectional view of the upper drum head of FIG. 3 taken along the line AA shown in FIG. 4A.
Figure 4A:
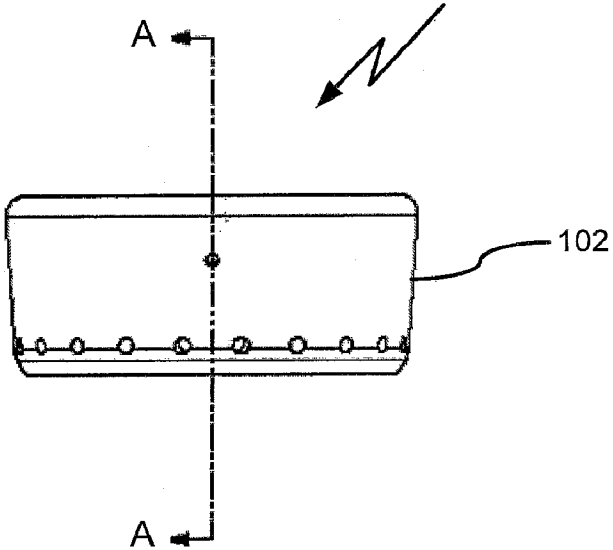
FIG. 4A shows a front view of the upper drum head of FIG. 3.

In FIG. 4A, a front view of the upper drum head 102 of FIG. 3 is shown, while FIG. 4B shows a cross-sectional view of the upper drum head of FIG. 3 taken along the line AA shown in FIG. 4A.

Figure 5:
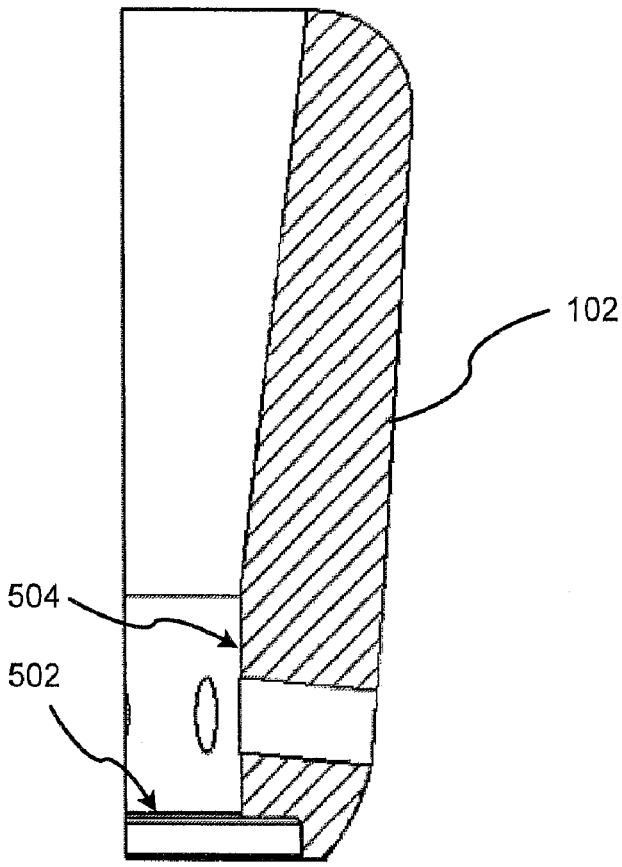
FIG. 5 is a diagram of a portion of the cross-sectional view of the upper drum head shown in FIG. 4B, illustrating details of its construction.

FIG. 5 is a diagram of a portion of the cross-sectional view of the upper drum head shown in FIG. 4B, illustrating details of its construction. FIG. 5 shows horizontal surface 502 and vertical surface 504 that may be formed around the entire interior circumference of the upper drum head 102. When the portable drum 100 is disassembled and in travel mode, the upper drum head 102 is inverted and the lower drum head 104 is placed inside the upper drum head 102 and kept in place by the notch formed by the horizontal surface 502 and the vertical surface 504.

Figure 6A:
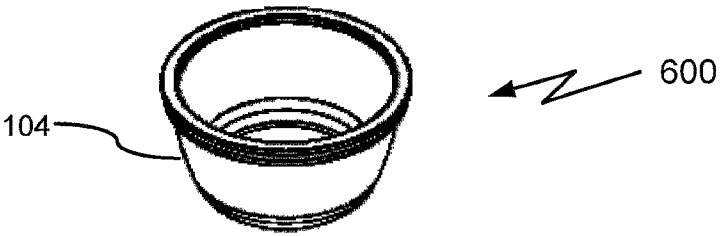
FIG. 6A shows a top perspective view of the lower drum head of FIG. 1.
Figure 6B:
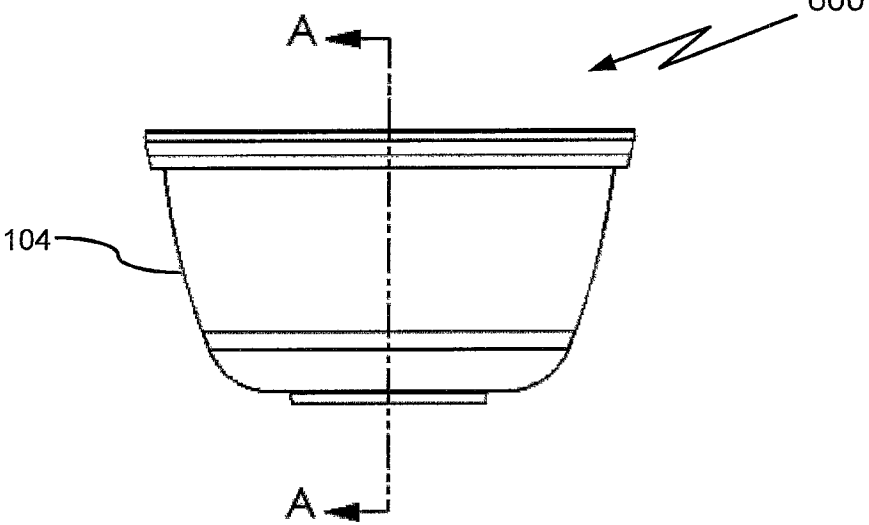
FIG. 6B shows a front view of the lower drum head of FIG. 6A.
Figure 6C:
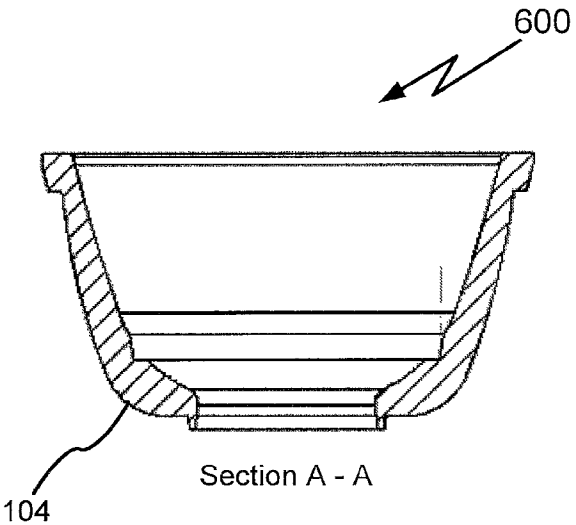
FIG. 6C shows a cross-sectional view of the lower drum head of FIG. 6A taken along the line AA shown in FIG. 6B.

In FIG. 6A, a top perspective view of the lower drum head 104 of FIG. 1 is shown. In FIG. 6B, a front view of the lower drum head 104 of FIG. 6A is shown, while FIG. 6C shows a cross-sectional view of the upper drum head of FIG. 6A taken along the line AA shown in FIG. 6B.

Figure 7A:
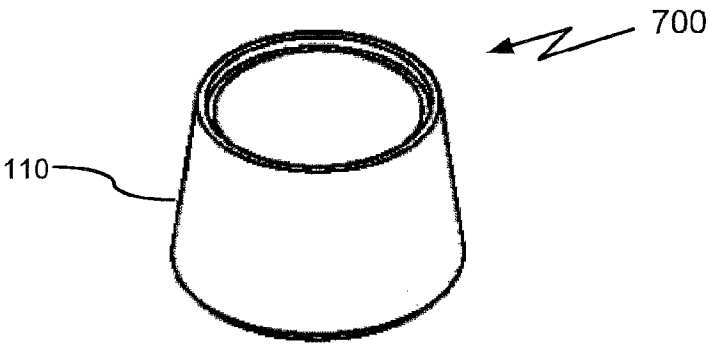
FIG. 7A shows a top perspective view of the first section of the drum shell of FIG. 1.
Figure 7B:
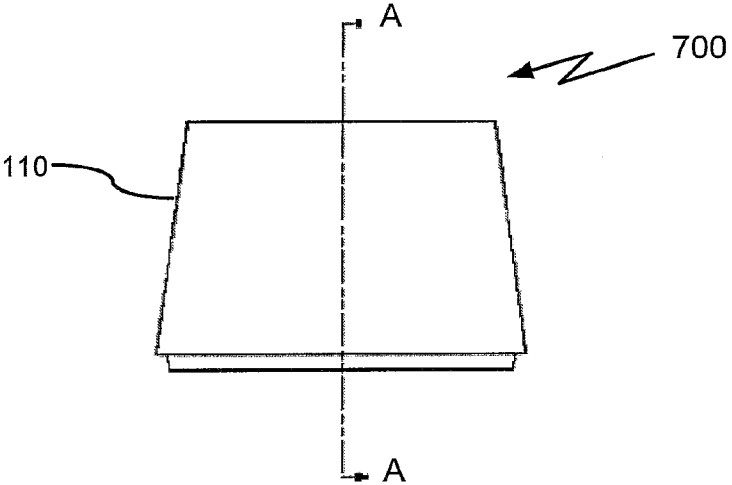
FIG. 7B shows a front view of the first section of the drum shell of FIG. 7A.
Figure 7C:
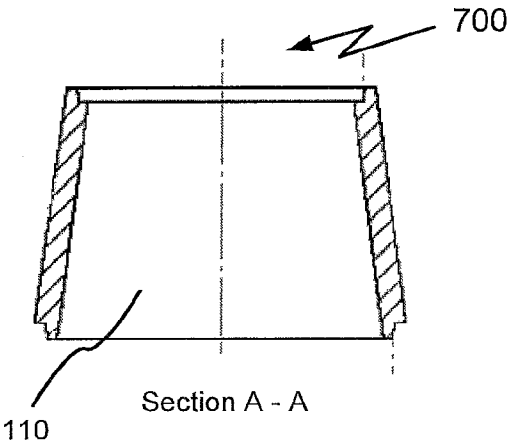
FIG. 7C shows a cross-sectional view of the first section of the drum shell of FIG. 7A taken along the line AA shown in FIG. 7B.

In FIG. 7A, a top perspective view of the first section 110 of the drum shell of FIG. 1 is shown. In FIG. 7B, a front view of the first section 110 of FIG. 7A is shown, while FIG. 7C shows a cross-sectional view of the first section 110 of FIG. 7A taken along the line AA shown in FIG. 7B.

Figure 8A:
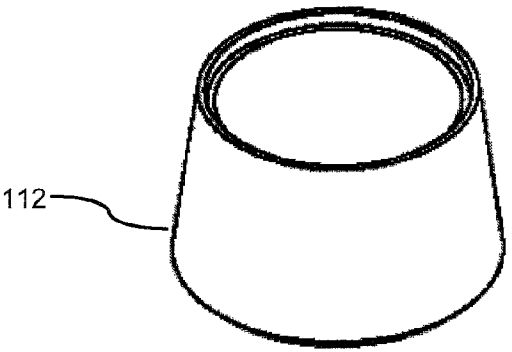
FIG. 8A shows a top perspective view of the second section of the drum shell of FIG. 1.
Figure 8B:
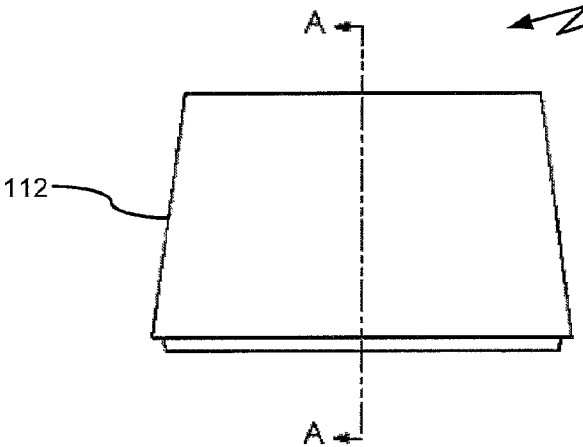
FIG. 8B shows a front view of the second section of the drum shell of FIG. 8A.
Figure 8C:
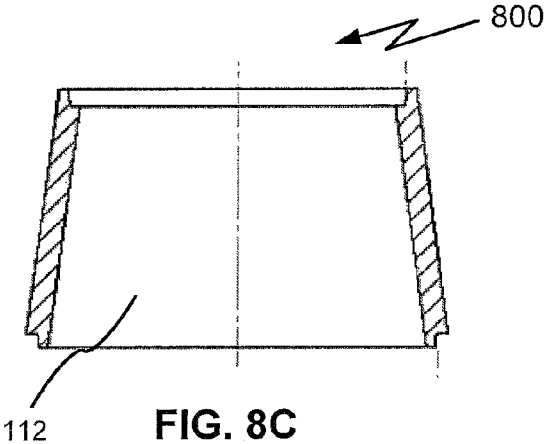
FIG. 8C shows a cross-sectional view of the second section of the drum shell of FIG. 8A taken along the line AA shown in FIG. 8B.

In FIG. 8A, a top perspective view of the second section 112 of the drum shell of FIG. 1 is shown. In FIG. 8B, a front view of the second section 112 of FIG. 8A is shown, while FIG. 8C shows a cross-sectional view of the second section 112 of FIG. 8A taken along the line AA shown in FIG. 8B.

Figure 9A:
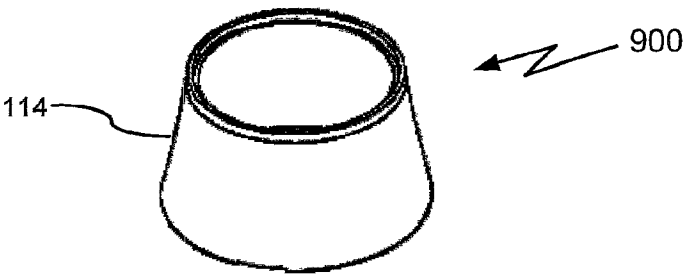
FIG. 9A shows a top perspective view of the third section of the drum shell of FIG. 1.
Figure 9B:
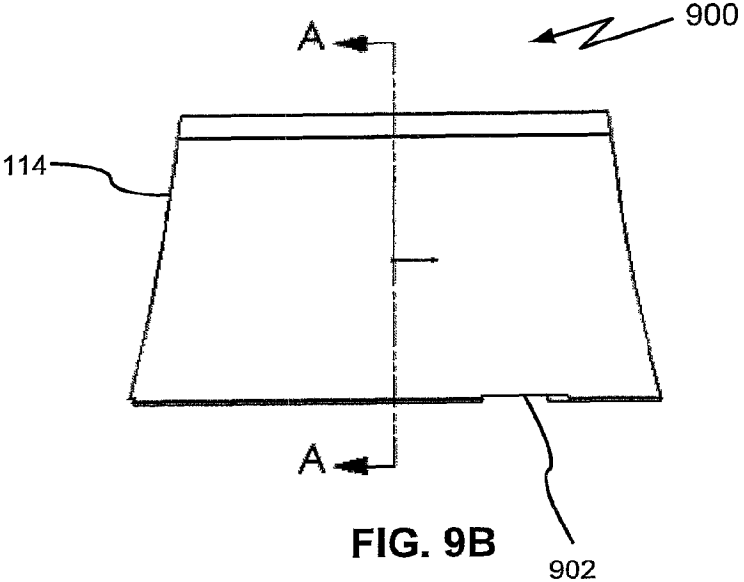
FIG. 9B shows a front view of the third section of the drum shell of FIG. 9A.
Figure 9C:
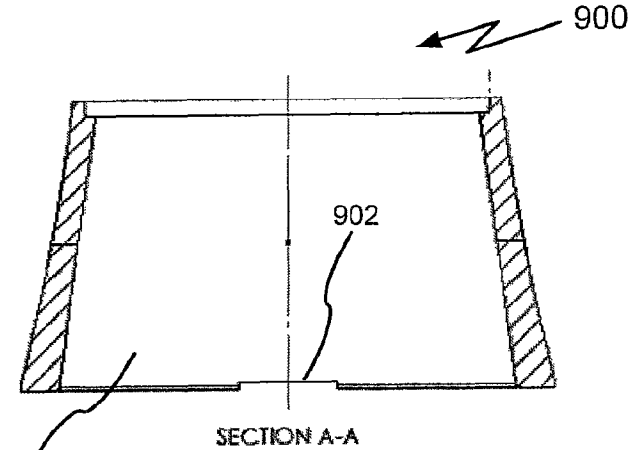
FIG. 9C shows a cross-sectional view of the third section of the drum shell of FIG. 9A taken along the line AA shown in FIG. 9B.

In FIG. 9A, a top perspective view of the third section 114 of the drum shell of FIG. 1 is shown. In FIG. 9B, a front view of the third section 114 of FIG. 9A is shown, while FIG. 9C shows a cross-sectional view of the third section 114 of FIG.

9A taken along the line AA shown in FIG. 9B. Because the third section 114 is the bottom-most part of the portable drum 100 in its fully assembled state, the third section 114 may include additional features that are utilized to hold the vertical straps 118, FIG. 1, in place. An example of such a feature is the indent 902 shown in the bottom rim of the third section 114, which may be used to hold a second attachment element 122, FIG. 1, that is attached to one end of a vertical strap 118, FIG. 1.

Figure 10A:
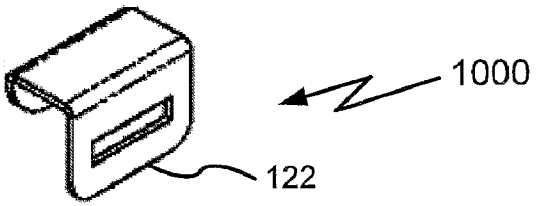
FIG. 10A shows a perspective view of an example of the second attachment element shown in FIG. 1.
Figure 10B:
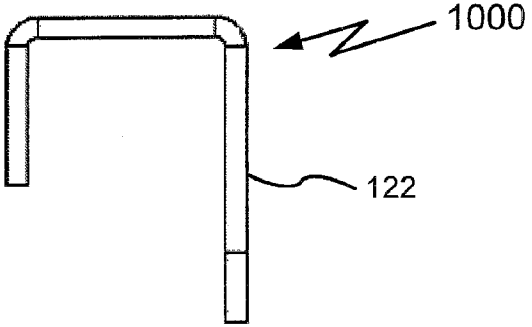
FIG. 10B shows a side view of the second attachment element shown in FIG. 10A.

Turning to FIG. 10A, a perspective view of an example of an implementation of the second attachment element 122 of FIG. 1 shown, which in this implementation, takes the form of a clamp that may be inserted into indent 902, FIG. 9, when assembling the portable drum 100, and used as a bottom anchor of the vertical straps 118, FIG. 1. FIGS. 10A and 10B are a side view and a top view, respectively, of the clamp shown in FIG. 10A.

Figure 11A:
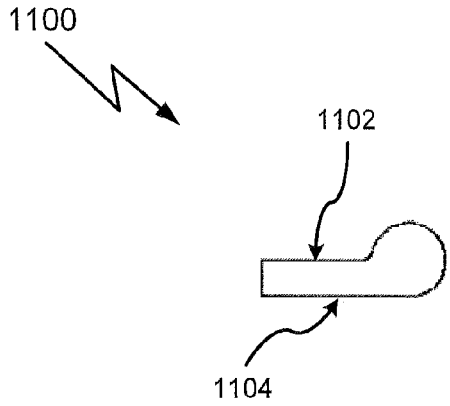
FIG. 11A shows a cross-sectional view of a gasket that may be used to create a seal between the various parts of the portable drum.

In FIG. 11A, a cross-sectional view of a gasket that may be used to create a seal between the various parts of the portable drum is shown. In an example implementation, the gasket 1100 may be fitted around the lower drum head 104, with the flat surface 1104 in contact with the bottom rim of the lower drum head 104. When assembled, the upper rim of the first section 110 of the drum shell is placed in contact with the raised surface 1102, forming a seal between the lower drum head 104 and the first section 110. It is appreciated by those skilled in the art that the flat surface 1104 may be attached to either end of an element of the portable drum and may be attached by methods that may include staples, tacking, or the use of adhesives.

Figure 11B:
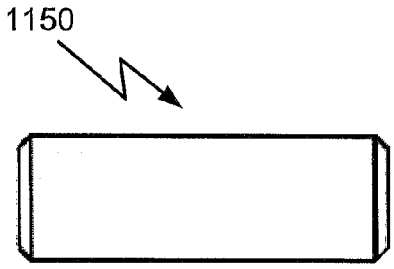
FIG. 11B shows a side view of an anchor peg that may be used as a lower tensioning anchor of the upper drum head of FIG. 3.
Figure 11C:
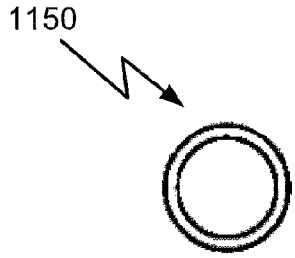
FIG. 11C shows an end view of the anchor peg shown in FIG. 11B.

In FIG. 11B, a side view of an anchor peg 1150 that may be used as a lower tensioning anchor of the upper drum head of FIG. 3 is shown. In an example implementation, the anchor peg 1150 may be inserted into each of the anchor holes 106, FIG. 3, around the lower drum head 104, and utilized in the tensioning of the membrane placed on the drum head. It is appreciated by those skilled in the art that other tensioning methods may be utilized that include the use of mechanical fasteners, such as rings and clamps. In FIG. 11C, an end view of the anchor peg of FIG. 11B is shown.

Figure 12B:
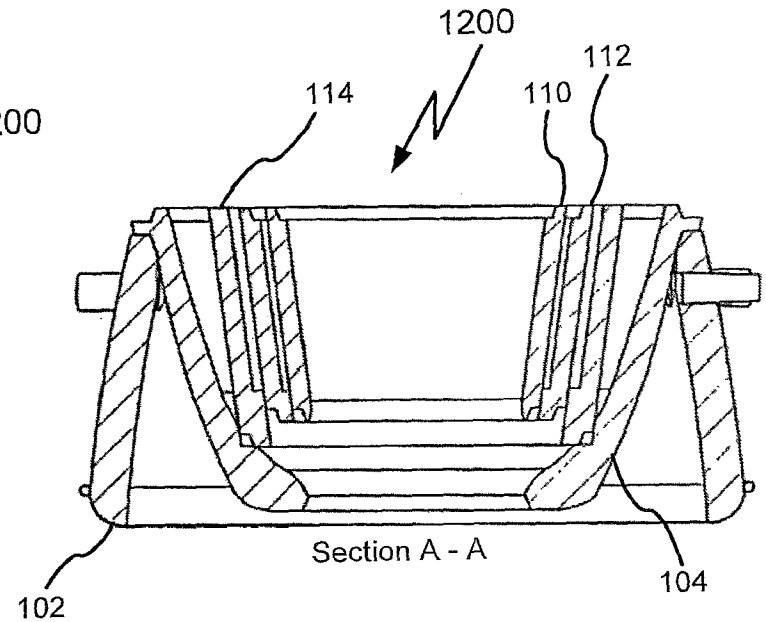
FIG. 12B shows a cross-sectional view of the portable drum of FIG. 12A taken along the line AA shown in FIG. 12A.
Figure 12A:
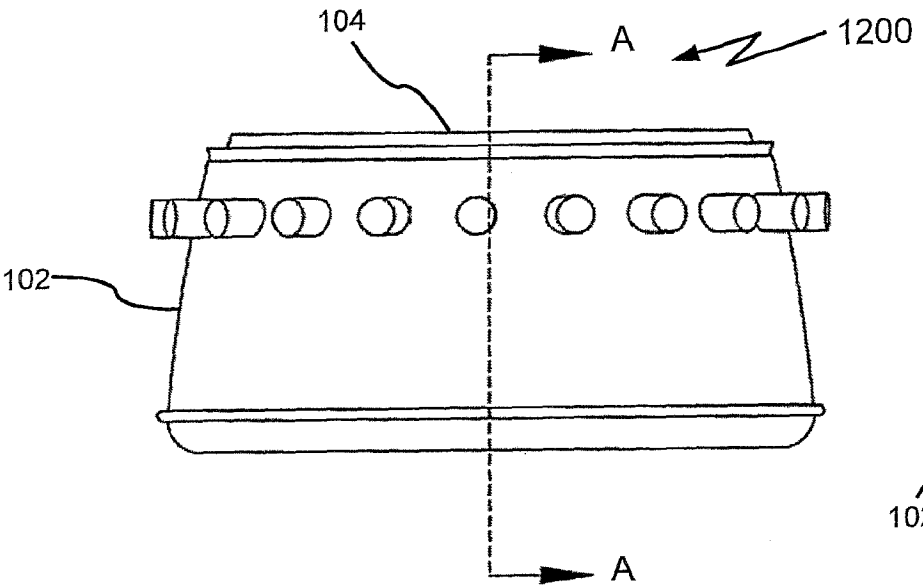
FIG. 12A shows a side view of one example of an implementation of a portable drum in a collapsed state (or travel mode).

Turning to FIG. 12A, a side view of an example of an implementation of a portable drum is shown, where the portable drum is in a collapsed state (or travel mode.) In FIG. 12*a*, the upper drum head 102 is shown in an inverted position, and the lower drum head 104 is placed into and rests on an interior rim of the upper drum head 102. The three sections that make up the drum shell (not shown) are inverted and then nested within each other and placed inside the lower drum head 104. Any vertical straps (not shown) and any other straps and belts may also be stored within the lower drum head 104, and the vertical straps (not shown) may also be connected to each other and used to hold in place anything else stored inside the lower drum head 104.

In FIG. 12B, a cross-sectional view of the portable drum 1200 of FIG. 12A taken along the line AA shown in FIG. 12A is shown, where the lower drum head 104 is resting within the inverted upper drum head 102. The third section 114 of the drum shell is shown nested inside the second section 112, and the second section 112 is shown nested inside the first section 110, with all three sections resting inside the lower drum head 104.

Figure 13:
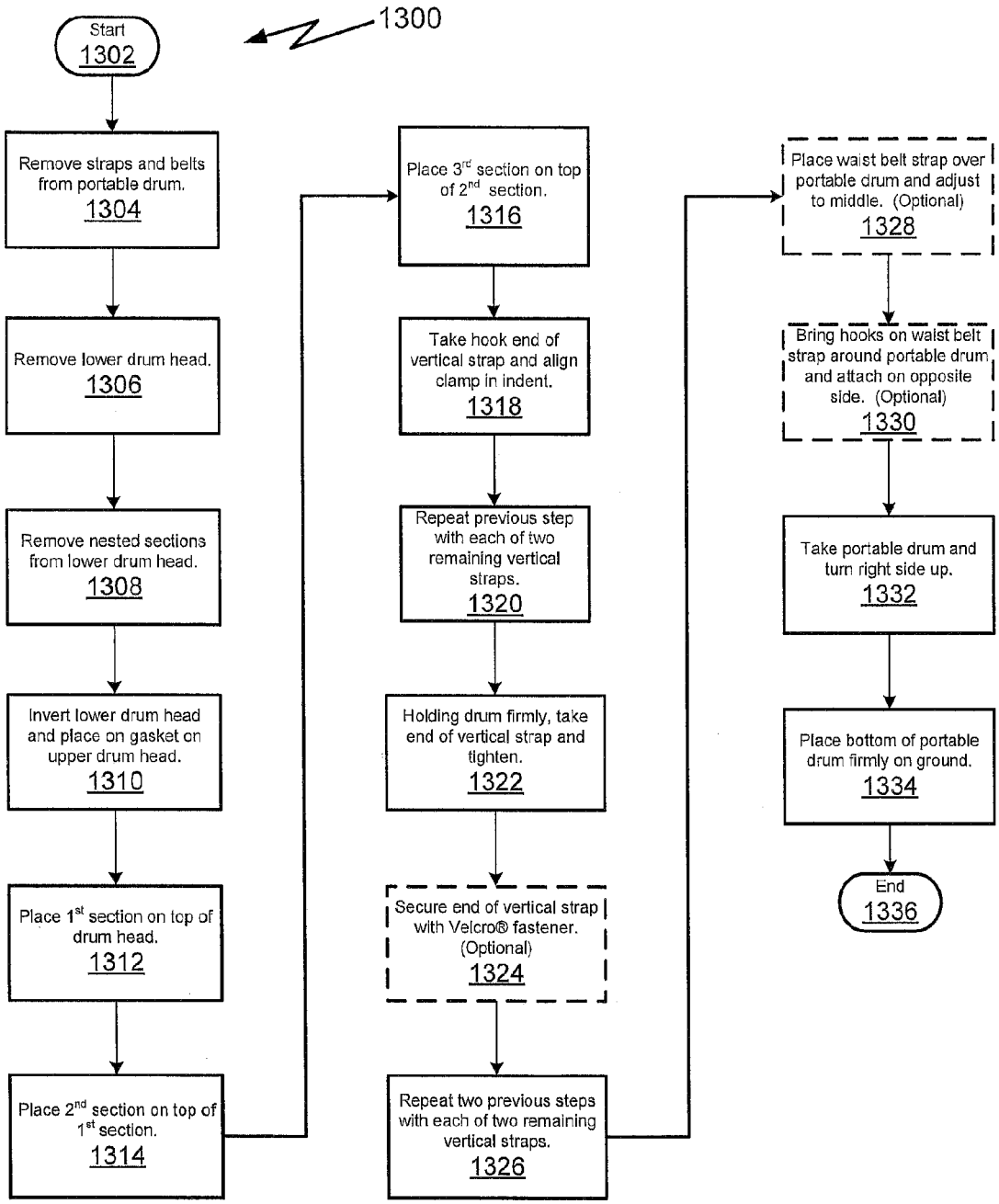
FIG. 13 is a flowchart illustrating an example method of assembling a portable drum in a collapsed state for operation of the portable drum in the play mode.

In FIG. 13, a flowchart illustrating an example method of assembling the portable drum in a collapsed state for operation of the portable drum in the play mode is shown. The example process 1300 starts in step 1302 where the user has a portable drum in a collapsed state, such as that shown in FIGS. 12*a* and 12B, where the portable drum is inverted and placed on a flat surface. In step 1304, the user removes all straps and belts from the center of the portable drum, such as, for example, vertical straps 118 and waist strap 124, FIG. 1.

In step 1306, the user removes the lower drum head 104, FIG. 12B, from the upper drum head 102, FIG. 12B, and then removes the third section 114, the second section 112, and the first section 110 from the lower drum head 104 in step 1308.

In step 1310, the lower drum head 104 is inverted and placed on the upper drum head 102 (which was previously inverted when the portable drum 1200 was in a collapsed state). In this step, the user must ensure that the lower drum head 104 makes complete contact with the upper drum head 102 and that the lower drum head 104 and the upper drum head 102 are correctly matched up and in complete contact. This may be achieved in some embodiments through the use of the gasket shown in FIG. 11 placed on the upper drum head 102 together with the interlocking joints between the various elements shown in FIG. 2B.

In step 1312, the first section 110 of the drum shell in an inverted position is placed on top of the inverted drum head made up of the upper drum head 102 and the lower drum head 104. It is essential for the sound quality of the assembled portable drum that there be a seal formed between the drum head and the drum shell, and to this end (as in the previous paragraph), the gasket shown in FIG. 11 may be placed on the lower drum head and held in place by means of interlocking joints. Although the illustrated embodiment shows the use of interlocking joints between the various elements of the portable drum together with gaskets, it is appreciated by those skilled in the art that the various interconnections between the various parts of the drum head and the drum shell may also be made by utilizing clamps, metal screws, magnetic and snap-to fit connectors, and various other types of fasteners and connectors, including threaded connections.

In step 1314, the second section 112 of the drum shell in an inverted position is placed on top of the first section, and in step 1316, the third section 114 of the drum shell in an inverted position is placed on top of the second section.

With all of the upper drum head 102, the lower drum head 104, and all sections of the drum shell in place, the next step is to use the tensioning system of the claimed invention to secure the parts of the portable drum in place. In step 1318, starting with one of the vertical straps 118, the user places the hook end of the vertical strap 118, which may be the clamp 122 shown in FIG. 10A, into an indent 902, FIG. 9C, formed in the bottom of the third section 114 of the drum shell.

In step 1320, the clamps 122 of the remaining two vertical straps 118 are placed into the appropriate indents 902 of the third section 114. Then the tightening process starts in step 1322, where one of the vertical straps 118 is tightened by pulling on the end of the strap while firmly holding the portable drum 100. Once the vertical strap 118 has been properly tightened, in optional step 1324 the end of the strap may be secured to the vertical strap 118 using a Velcro® fastener.

In step 1326, steps 1322 and 1324 are repeated with the remaining two vertical straps 118. Steps 1322, 1324, and 1326 may also be performed in an alternating sequence between the vertical straps 118, so that each vertical strap 118 is incrementally adjusted to achieve the desired tension in the vertical straps 118. The desired net effect is that all of the vertical straps are perpendicular to the surface on which the portable drum 100 is resting.

Proceeding to optional step 1328, a waist belt strap 124, which may be a bungee cord, may be placed over the portable drum 100 and the vertical straps 118, and then moved to approximately the middle of the portable drum 100 or to its smallest diameter. In optional step 1330, the waist belt strap 124 is tightened, thus causing the vertical straps 118 to more closely conform to the contours of the portable drum 100 as well increasing the tension in the vertical straps 118, if this desired.

In step 1332, the fully assembled portable drum is turned right side up, and in step 1334, the fully assembled portable drum is placed firmly on the ground. The process ends at step 1336.

Figure 14:
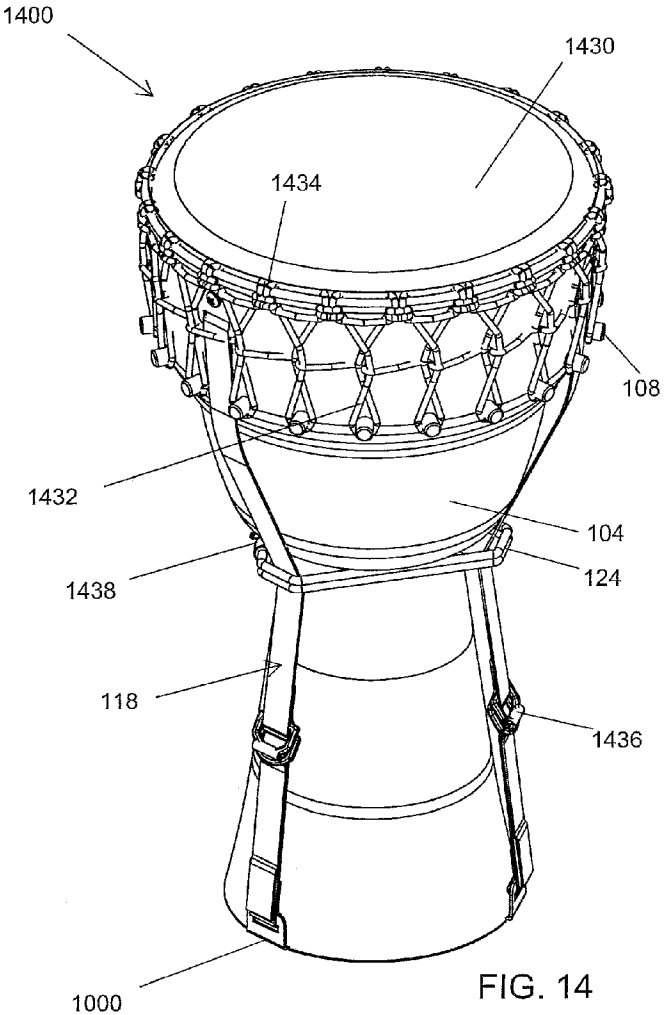
FIG. 14 shows a top front perspective view of one example of an implementation of a portable drum in a fully assembled state with a membrane attached to the drum head.

In FIG. 14, a top front perspective view of one example of an implementation of a portable drum in a fully assembled state with a membrane attached to the drum head is shown. As shown in FIGS. 1, 2A, and 2B, this implementation includes an upper drum head 102 and a lower drum head 104 resting on a drum shell comprised of three sections, held in place by vertical straps 118. Vertical straps 118 are tightened by utilizing D-rings 1436. Also included is waist belt strap 124, which in this implementation is a bungee cord held in place by hooks 1438, that may be adjusted to have the vertical straps 118 conform more closely to the contours of the portable drum 1400 and may also increase the tension in the vertical straps 118.

In this implementation, a membrane 1430 is shown stretched over the upper drum head 102 and held in place by ropes 1432 that are intertwined between the anchor pegs 108 and rings 1434 inserted in the membrane 1430. Once in place, the tension in the drum head may be adjusted and the portable drum tuned by adjusting the ropes 1432 as needed, which may be accomplished by, for example, twisting the ropes as they stretch overtime. Utilizing the series of pegs 108 with the rings 1434 assist in holding the membrane 1430 level when tensioning the membrane 1430 on the upper drum head 102.

Figure 15B:
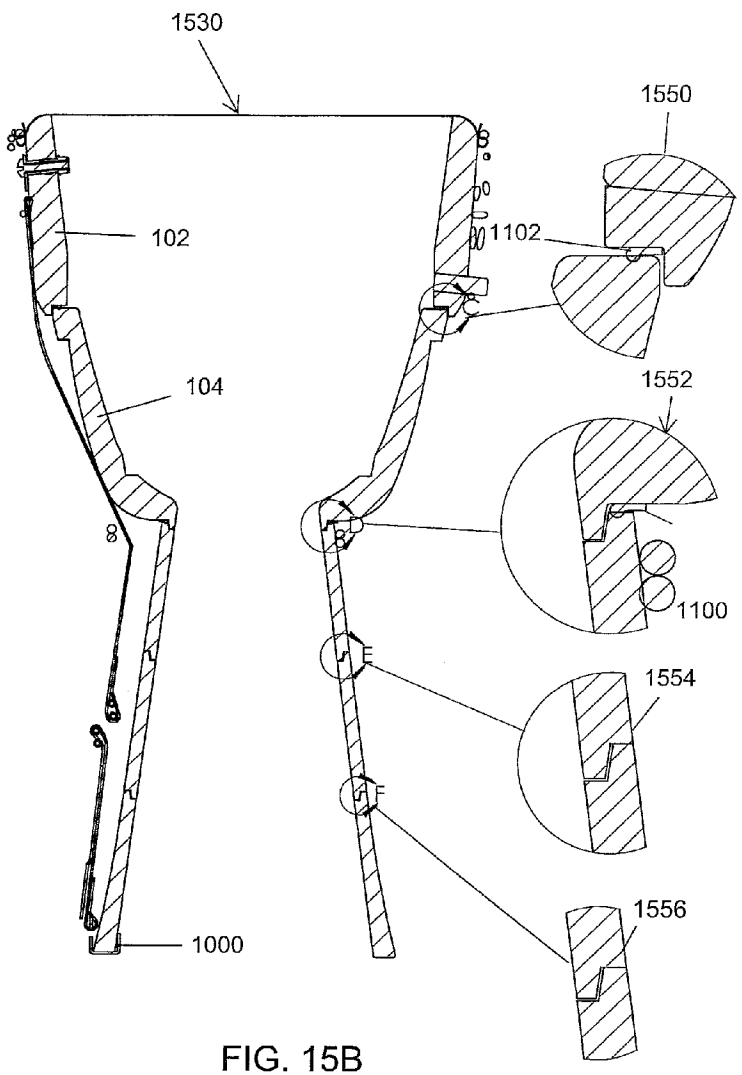
FIG. 15B shows a cross-sectional view of the portable drum of FIG. 14 taken along the line BB shown in FIG. 15A.
Figure 15A:
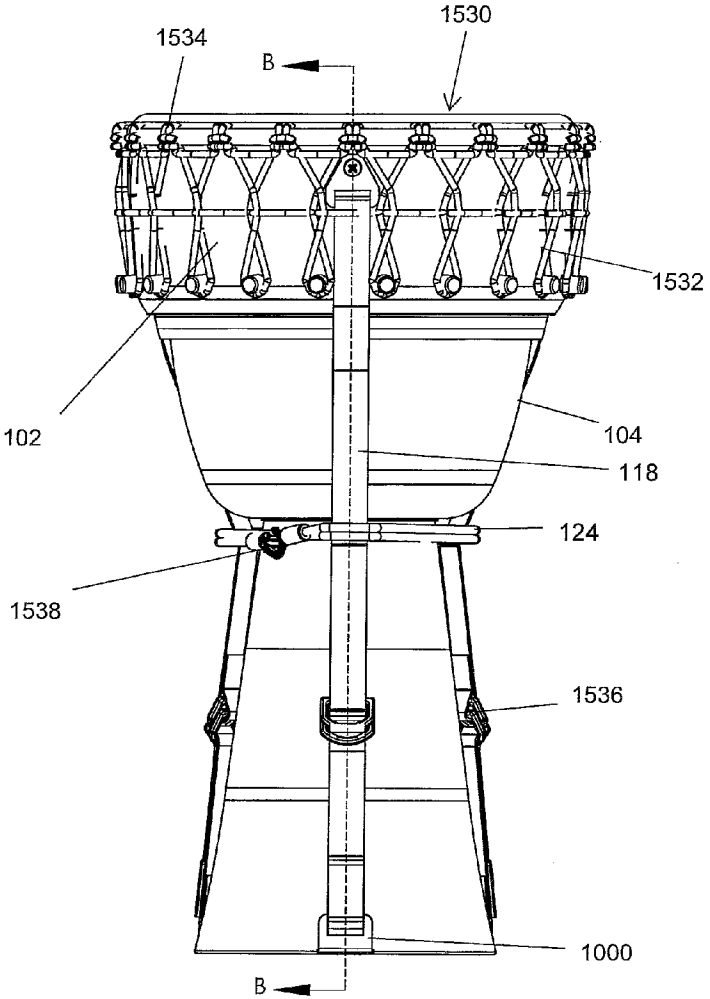
FIG. 15A shows a front view of the portable drum of FIG. 14.

Turning to FIG. 15A, a front view of the portable drum of FIG. 14 in an upright position, as it would appear if placed firmly on an even surface in play mode. In this view, an upper drum head 102 and a lower drum head 104 is shown resting on a drum shell comprised of three sections, held in place by vertical straps 118. Vertical straps 118 are tightened by utilizing D-rings 1536. Also included is waist belt strap 124, which in this implementation is a bungee cord held in place by hooks 1538, that may be adjusted to have the vertical straps 118 conform more closely to the contours of the portable drum 1400 and may also increase the tension in the vertical straps 118.

Figure 10C:
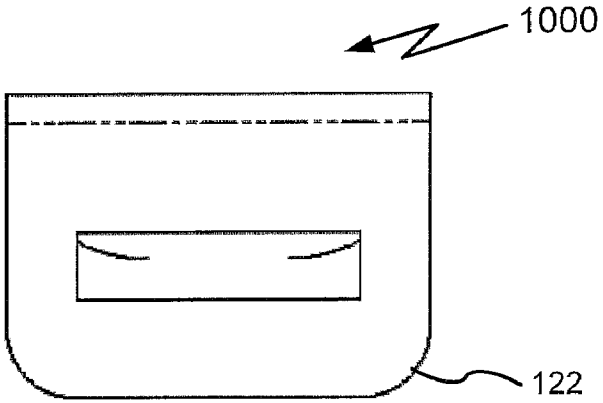
FIG. 10C shows a top view of the second attachment element shown in FIG. 10A.

Again, a membrane 1530 is shown stretched over the upper drum head 102 and held in place by ropes 1532 that are intertwined between the anchor pegs 108 and rings 1536 inserted in the membrane 1530. Once in place, the tension in the drum head may be adjusted and the portable drum tuned by adjusting the ropes 1532 as needed. The three vertical straps 118 are visible, with each of the parts having the same reference numbers as FIG. 1. Also shown is clamp 1000, FIG. 10, which holds each vertical strap 118 in place at the bottom of the portable drum 1400.

In FIG. 15B, a cross-sectional view of the portable drum of FIG. 14 taken along the line BB shown in FIG. 15A is shown. In FIG. 15B, the membrane is stretched over the upper drum head 102, which rests on lower drum head 104. Inset 1550 shows the interlocking of the upper drum head 102 and lower drum head 104, and the placement of gasket 1100 (FIG. 11) between these two parts of the portable drum. Shown in insets 1552, 1554, and 1556 are the interconnections the lower drum head 104 and the first section of the drum shell, the first section of the drum shell and the second section, and the second section of the drum shell and the third section, respectively. (Insets 1550, 1552, 1554, and 1556 show the same detail as insets 202, 204, 206, and 208 of FIG. 2).

Figure 15C:
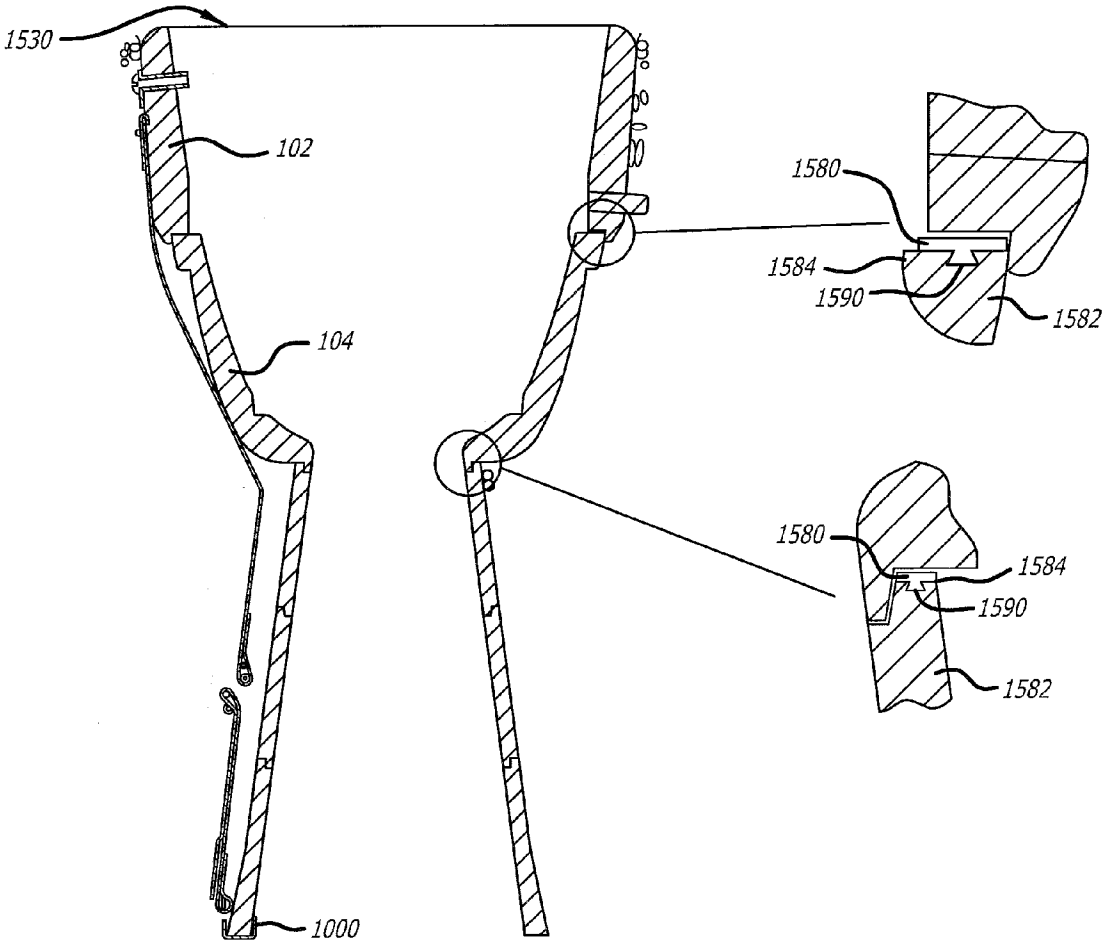
FIG. 15C shows an alternative cross-sectional view of the portable drum of FIG. 14 taken along the line BB shown in FIG. 15A.

FIG. 15C shows an alternative cross-sectional view of the portable drum of FIG. 14 taken along the line BB shown in FIG. 15A. As illustrated is FIG. 15B, the gaskets 1100 between the parts of the portable drum may be designed as separate independent pieces that are formed to fit between two parts of the portable drum. Alternatively, as illustrated in FIG. 15C, the gasket can be a molded gasket 1580 that is molded directly on one of the two parts (i.e., a first part) 1582 upon which the gasket 1580 is to be positioned between. In this example of an implementation, the first part 1582 may include a groove 1590 that extents around a central or inner perimeter of the top edge 1584 of the first part 1582. The groove 1590 may also be positioned at intervals about the perimeter. Those skilled in the art will further recognize that grooves 1590 may positioned at other locations about the perimeter, in various positions, and may take a variety of shapes, including, but not limited to holes. The cross-section of the groove 1590 shown in FIG. 15C is merely one example of how the gasket 1580 may be molded to the first part 1582 to maintain the gasket 1580 against the first part 1582.

To form the gasket 1580, a mold (not shown) is positioned around the perimeter of the top edge 1584 of the first part 1582. Hot or melted rubber material, such as urethane, is then injected into the mold, which fills the mold and flows into grooves 1590. Once the urethane has cooled, the mold is removed and the formed urethane gasket 1580 remains. With the incorporation of the gasket 1580 into the grooves 1590 in the first part 1582, the gasket 1580 is prevented from slipping upon assembly of the drum, and enables a tight seal between the two parts in which the gasket is seated.

While various embodiments of the invention have been described, it will be apparent to those of ordinary skill in the art that many more embodiments and implementations are possible that are within the scope of this invention.

What is claimed is:

1. A portable drum comprising:

a drum head having an upper drum head and a lower drum head configured for detachable engagement with each other;

a drum shell configured for detachable engagement with the drum head, the drum shell having a plurality of sections configured for detachable engagement with the drum head;

interconnecting mechanisms configured to interconnect each of the upper drum head, the lower drum head, and the sections with each other;

a molded gasket having a flat surface and a raised surface where the flat surface is molded onto an upper or lower rim of any of the upper drum head, the lower drum head, and the sections;

interlocking joints between any of the upper drum head, the lower drum head, and the sections to be joined to each other; and a tensioning system capable of securing the drum head and the drum shell in an assembled state.

2. The portable drum of claim 1, wherein the tensioning system includes a plurality of vertical straps attached to the upper drum head and to a lowermost section of the plurality of sections.

3. The portable drum of claim 2, wherein each of the vertical straps include a first attachment element and a second attachment element.

4. The portable drum of claim 3, wherein the first attachment element includes a mechanical fastener attaching one end of the vertical strap to the upper drum head.

5. The portable drum of claim 3, wherein the second attachment element includes a clamp attached to one end of the vertical strap configured for insertion into an indent formed in a lowermost section of the plurality of sections.

6. The portable drum of claim 3, wherein the each of the vertical straps further includes means for adjusting the tension of the vertical strap when in place.

7. The portable drum of claim 2, wherein the tensioning system further includes a waist belt strap configured to be placed around the vertical straps when in place.

8. The portable drum of claim 1, where:

the plurality of sections is configured for nested storage as a single unit;

the single unit is configured for storage within lower drum head; and the lower drum head is configured for storage within the upper drum head.

9. A portable drum comprising:

a drum head having an upper drum head and a lower drum head;

a plurality of anchor pegs inserted into the drum head configured for tensioning the drum head;

a drum shell configured for detachable engagement with the drum head, the drum shell having a plurality of sections configured for detachable engagement with the drum head;

interconnecting mechanisms configured to interconnect each of the upper drum head, the lower drum head, and the sections with each other;

a molded gasket having a flat surface and a raised surface where the flat surface is molded onto an upper or lower rim of any of the upper drum head, the lower drum head, and the sections;

interlocking joints between any of the upper drum head, the lower drum head, and the sections to be joined to each other; and a tensioning system capable of securing the drum head and the drum shell in an assembled state.

10. The portable drum of claim 9, wherein the anchor pegs are inserted into the upper drum head.

11. The portable drum of claim 9, further including a membrane placed over a top of the upper drum head and connected to the anchor pegs by one or more ropes.

* * * * *